United States Patent [19]

Lagally et al.

[11] Patent Number: 4,893,671

[45] Date of Patent: Jan. 16, 1990

[54] STEAM GENERATOR TUBE ANTIVIBRATION APPARATUS AND METHOD

[75] Inventors: Hermann O. Lagally, Hempfield Township, Westmoreland County; Thomas A. Pitterle, Unity Township, Westmoreland Township, both of Pa.

[73] Assignee: Westinghouse Electric Corp., Pittsburgh, Pa.

[21] Appl. No.: 208,714

[22] Filed: Jun. 20, 1988

[51] Int. Cl.[4] ..... F28F 7/00

[52] U.S. Cl. ..... 165/162; 29/157.3 R; 29/157.4; 122/510; 165/69

[58] Field of Search ..... 29/157.3 R, 157.4; 122/510; 165/69, 162

[56] References Cited

U.S. PATENT DOCUMENTS

| | | | |
|---|---|---|---|
| 1,813,405 | 7/1931 | Kerr . | |
| 2,142,367 | 1/1939 | Morgan . | |
| 2,161,019 | 6/1939 | Coy . | |
| 3,007,679 | 11/1961 | Byerley et al. . | |
| 3,163,208 | 12/1964 | Cuzzone et al. | 165/69 |
| 3,199,582 | 8/1965 | Vogt et al. | 165/69 |
| 3,212,567 | 10/1965 | Romanos | 165/69 |
| 3,575,236 | 4/1971 | Romanos | 165/162 |
| 3,637,008 | 1/1972 | Michel et al. | 165/69 |
| 3,820,594 | 6/1974 | Ritland et al. | 165/69 |
| 4,136,736 | 1/1979 | Small | 165/162 |
| 4,204,570 | 5/1980 | Eisinger | 165/69 |
| 4,286,366 | 9/1981 | Vinyard | 29/157.4 |
| 4,553,588 | 11/1985 | Geissler | 165/162 |
| 4,640,342 | 2/1987 | Appleman | 165/69 |
| 4,653,576 | 3/1987 | Lagally | 165/69 |
| 4,720,840 | 1/1988 | Lagally et al. | 165/162 X |
| 4,789,028 | 12/1988 | Gowda et al. | 165/162 |

FOREIGN PATENT DOCUMENTS 0711630 6/1965 Canada .

*Primary Examiner*—Gerald A. Michalsky

[57] ABSTRACT

A steam generator has a bundle of U-shaped tubes arranged in spaced rows and columns with a pair of spaced rows of elongated primary antivibration bars installed between U-shaped portions of the tubes in the spaced columns and a pair of spaced retainer members disposed about the exterior of U-shaped portions of the tubes with opposite ends of the primary bars being rigidly attached to the respective retainer members. An antivibration apparatus is provided for substantially closing gaps between the U-shaped tube portions in the columns and the primary bars. The apparatus includes a row of elongated supplementary antivibration bars disposed between the rows of the primary bars. The supplementary bars extend between the U-shaped portions of the tubes through the space between, at the most, every other one of the spaced columns thereof. A support member extends across the outside of the U-shaped portions of the tubes and the supplementary bars are rigidly attached at their outer ends to the support member such that they are unsupported at their inner ends and thereby extend in cantilevered fashion between tubes. Each supplementary bar is capable of expansion in a transverse dimension extending between the tubes so as to cause deformation laterally outward away from the respective supplementary bars of longitudinal spans of the tubes extending between the spaced row of primary bars for substantially closing any gaps existing between the tubes and primary bars.

13 Claims, 6 Drawing Sheets

STEAM GENERATOR TUBE ANTIVIBRATION APPARATUS AND METHOD

CROSS REFERENCE TO RELATED APPLICATION

Reference is hereby made to the following copending application dealing with related subject matter and assigned to the assignee of the present invention: "Anti-Vibration Bars For Nuclear Steam Generators" by B. V. Gowda et al, assigned U.S. Ser. No. 07/051,160, filed May 15, 1987, now U.S. Pat. No. 4,789,028, being a division of U.S. Ser. No. 06/670,728, filed Nov. 13, 1984, and now abandoned.

BACKGROUND OF THE INVENTION

1. Field of the Invention

The present invention generally relates to steam generators for commercial nuclear power plants and, more particularly, is concerned with apparatus and method for preventing vibration of the columns of steam generator tubes and originally-installed antivibration bars during operation of the steam generator.

2. Description of the Prior Art

Heat produced by fission in a nuclear reactor core of a nuclear power plant is transferred to a primary reactor coolant flowing through the reactor core. The primary reactor coolant then flows through steam generators of the nuclear power plant where it transfers the heat to a secondary feedwater which is transformed thereby into steam. The steam is used to generate electricity by driving a conventional steam turbine-electrical generator apparatus.

Each steam generator has a large bundle of U-shaped tubes. The high temperature primary reactor coolant from the reactor core enters the steam generator through a coolant inlet nozzle and exits therefrom through a coolant outlet nozzle, both of which are located in the lower portion of the steam generator, after flowing through the interior of the tubes. The secondary feedwater enters the steam generator through a feedwater inlet nozzle and exits therefrom through a feedwater exit nozzle, both of which are located in the upper portion of the steam generator, after flowing along the exterior of the tubes. Thus, the interior coolant and exterior feedwater flows are in heat exchange relationship with one another but separated by the walls of the tubes.

The U-shaped tubes in the bundle thereof are arranged in successive columns and rows, and supported at their lower open ends by sealed attachment to a tube sheet which is disposed transverse to the longitudinal axis of the steam generator. A series of tube supports arranged in axially spaced relationship to each other support the straight portions of the tubes in the columns and rows thereof. An upper tube support assembly is utilized to support the upper U-shaped portions of the tubes in the spaced columns and rows.

More particularly, the upper tube support assembly includes a plurality of retainer rings arranged around the outside periphery of the tube bundle in axial spaced relationship to each other. The retainer rings, like the tube supports, are arranged substantially transverse to the axis of the steam generator. Each retainer ring is generally of an oval shape which coincides with the outside periphery of the tube bundle at the particular location of the ring. Thus, the size of the oval of the retainer ring decreases with the distance toward the upper end of the tube bundle. The uppermost retainer ring, therefore, is relatively small inasmuch as it is located at the uppermost portion of the tube bundle where the shape of the tube bundle is rapidly converging.

Each of the retainer rings is connected to a plurality of antivibration bars which are typically originally installed between each column of the U-shaped portions of the tubes. In some steam generators, the antivibration bars take the form of a bar bent into a V-shaped configuration such that two legs are formed with an angle therebetween. The angles of the bars range from obtuse in the lower one of the bars to acute in the higher one of the bars. The V-shaped bars are inserted between the successive columns of the steam generator flow tubes with the free ends of the bars being rigidly attached to the opposite sides of the appropriate retainer ring.

The antivibration bars are intended to prevent excessive vibration of the individual steam generator tubes. It is well known that the vibrations in question are caused by the interaction of the flexibility of the flow tubes with flow of water and steam past the tubes, and that the U-shaped portions of the tubes are most severely affected by the vibrations. However, the mechanical aspects of the curved or bent portions of the tubes are the major obstacles in the way of a solution to the problem. The U-shaped tubes have dimensional tolerances associated with their outer diameters. There are also variations caused by ovalization of the tubes as a result of the bending. Furthermore, the spatial relationship between adjacent tubes is a variable, albeit within set design limits. Thus, there is a dimensional tolerance associated with the nominal spacing between steam generator tubes. There is also a dimensional tolerance associated with the outer dimensions of the prior art vibration bars. Also, the bars must be slightly smaller than the space between adjacent columns of tubes in order to permit insertion of the bars therebetween.

The combination of these tolerances and dimensional variances means that the presence of gaps persists between the originally-installed antivibration bars and the tubes of the steam generator. Any gaps are, of course, undesirable because they allow flow-induced vibration of the tubes and relative motion between the tubes and the originally-installed antivibration bars. The relative motion can cause the tubes and bars to interact over time resulting in damaging wear and subsequent failure to the tubes of the steam generator.

Up to the present, the approach to elimination of the gaps between the originally-installed antivibration bars and the steam generator tubes has been complete replacement of the bars with one or combinations of several different types of replacement antivibration bars designed for that purpose: that is, removal of the originally installed bars, and installation of a complete new set of bars. Appleman U.S. Pat. No. (4,640,342), Lagally U.S. Pat. No. (4,653,576) and Lagally et al U.S. Pat. No. (4,720,840) describe the various replacement antivibration bars and their installation.

While complete replacement of the originally installed antivibration bars is a step in the right direction, it is tedious and time consuming and thus costly to carry out. Its cost has been rejected by at least one utility as not justified by the remaining life of the steam generators. Consequently, a need still exists for a less costly, but effective, technique for antivibration bar gap elimination which would minimize the cost for utilities.

SUMMARY OF THE INVENTION

The present invention provides steam generator antivibration apparatus and method designed to satisfy the aforementioned needs. The apparatus and method of the present invention provides a low cost approach, being only 25 to 50% of the cost of the current complete replacement approach, to elimination of the clearance space or gaps between the steam generator tubes and the originally-installed antivibration bars disposed between columns of the tubes and thereby prevention of vibration and wear of the tubes during operation of the steam generator. The low cost approach of eliminating antivibration bar gap of the present invention is based on leaving the original antivibration bars in the tube bundle, and combining use of the natural flexibility of the tubes as the protection mechanism against deformation of sections of the tubes with use of the existing designs of the replacement antivibration bars in the supplementary antivibration bars to achieve the cost reduction.

Accordingly, the present invention is directed to antivibration apparatus and method used in a steam generator for substantially closing gaps between the U-shaped portions of tubes in columns thereof and the primary antivibration bars in the steam generator. The apparatus and method include the following operative steps: (a) inserting at least one row of a plurality of elongated supplementary antivibration bars between the rows of the primary antivibration bars and between the U-shaped portions of the tubes through the space between, at the most, every other one of the spaced columns thereof; (b) supporting the supplementary bars at respective outer ends thereof such that the supplementary bars are unsupported at respective inner ends thereof and thereby extend in cantilevered fashion between the U-shaped portions of the tubes; and (c) expanding each of the supplementary bars in a transverse dimension thereof extending between the tubes so as to cause deformation laterally outward away from the respective bars of longitudinal spans of the tubes extending between the spaced row of primary bars for substantially closing any gaps existing between the U-shaped tube portions in the columns thereof and the primary antivibration bars. Also, the respective outer ends of the supplementary bars are rigidly attached to a support member extending across the outside of the U-shaped portions of the tubes.

In one embodiment, the expanding of each supplementary bar includes moving first and second longitudinally extending side-by-side portions thereof relative to one another. In another embodiment, the expanding of each supplementary bar includes quarter-turning the bar about its own longitudinal axis to disposed the width of the bar, which is greater than the thickness of the bar, between the tubes.

Also, the present invention is directed to a supplementary antivibration member for placement between a pair of columns of steam generator tubes. The supplementary member includes an elongated bar of rectangular cross-section with two pairs of diagonally opposite longitudinal edges. The bar has a greater width than thickness and is rounded off at one of the pairs of the diagonally opposite longitudinal edges and squared off at the other of the pairs of diagonally opposite longitudinal edges such that the bar is adapted to be inserted with its thickness extending between the pair of tube columns and then quarter-turned to position its width therebetween to cause deformation longitudinal spans of the tubes away from one another.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
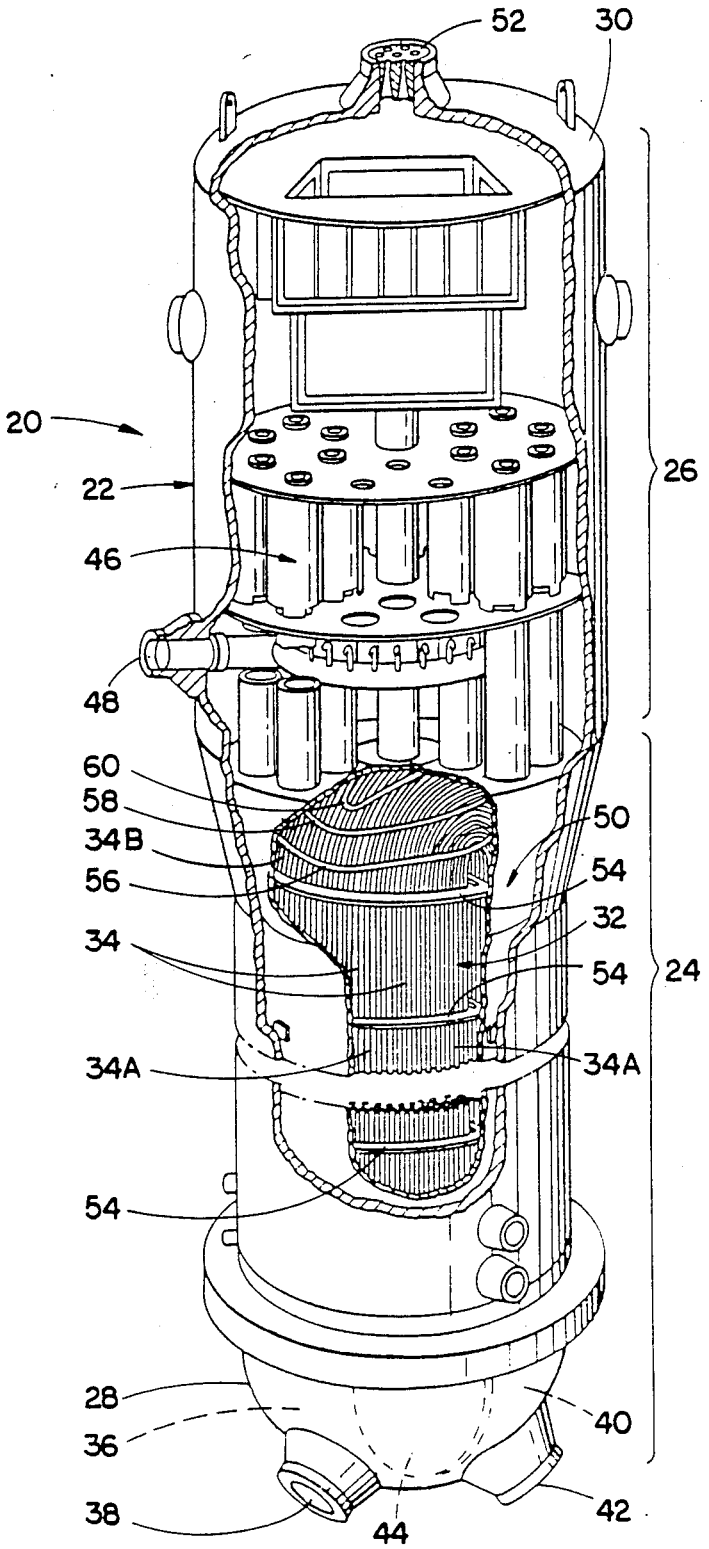
FIG. 1 (PRIOR ART)
FIG. 1 is a perspective view partially in section and partly broken away, of a conventional steam generator of a nuclear reactor power plant having U-shaped bent heat transfer tubes and antivibration bars applied between the tubes and to which the supplementary antivibration bars of the present invention may be applied.

In the following description, like reference characters designate like or corresponding parts throughout the several views. Also in the following description, it is to be understood that such terms as "forward", "rearward", "left", "right", "upwardly", "downwardly" and the like, are words of convenience and are not to be construed as limiting terms.

1. In General

Referring now to the drawings, and particularly to FIG. 1, there is shown a steam generator, generally designated 20, of a nuclear reactor power plant, such as a pressurized water reactor (PWR). The steam generator 20 includes substantially cylindrical shell 22 having lower and upper portions 24,26. A hemispherical channel head 28 is sealingly attached to the lower shell portion 24 and another head 30 is sealingly attached to the upper shell portion 24. A bundle 32 of U-shaped tubes 34 is disposed within the lower shell portion 24. One open end of the tube bundle 32 is in flow communication with a hot leg 36 of the lower channel head 28 and a primary reactor coolant flow inlet nozzle 38 defined thereon. The other open end of the tube bundle 32 is in flow communication with a cold leg 40 of the lower channel head 28 and a primary reactor coolant flow outlet nozzle 42 defined thereon. A partition 44 divides the hot and cold legs 36,40 of the lower channel head 28. Thus, hot reactor coolant flows into the steam generator 20 through the inlet nozzle 38, through the hot leg 36 of the lower channel head 28 into the tube bundle 32, and through and out of the tube bundle. The now cooled reactor coolant flows through the cold leg 40 and out of the outlet nozzle 42 and back to the nuclear reactor core to continue the flow cycle.

The lower shell portion 24 of the steam generator 20 primarily including the tube bundle 32 and lower channel head 28 is referred to as the evaporator portion. The upper shell portion 26 of the steam generator 20 is normally referred to as the steam drum portion which includes a moisture separator 46. Feedwater enters the steam generator 20 through a feedwater flow inlet nozzle 48 and mixes with water removed by the moisture separator 46. The feedwater flows down an annular channel 50 surrounding the tube bundle 32 and is introduced to the tube bundle 32 along the exterior of the tubes 34 thereof at the bottom of the bundle. The feedwater then flows up through the tube bundle 32 along the exterior of the tubes 34 thereof where it is heated to a boil by the hot reactor coolant flowing within the interior of the tubes 34. The steam produced by the boiling feedwater rises up into the steam drum portion 26 where the moisture separator 46 removes water entrained within the steam before the steam exits through a steam outlet nozzle 52. The steam then flows to a steam turbine (not shown) and subsequently back into the steam generator 20 as feedwater where the cycle is continued.

The U-shaped tubes 34 of the steam generator 20 being arranged in successive horizontally spaced columns and vertically spaced rows are supported along their straight portions 34A in the configuration of the tube bundle 32 by a series of axially spaced support plates 54. The upper bent or U-shaped portions 34B of the tubes 34 are supported by a series of retainer rings 56,58,60. Each of the retainer rings 56,58,60 is generally of round or oval configuration with the middle ring 58 being smaller than the lower ring 56, and the upper ring 60 smaller than the middle ring 58.

Figure 2:
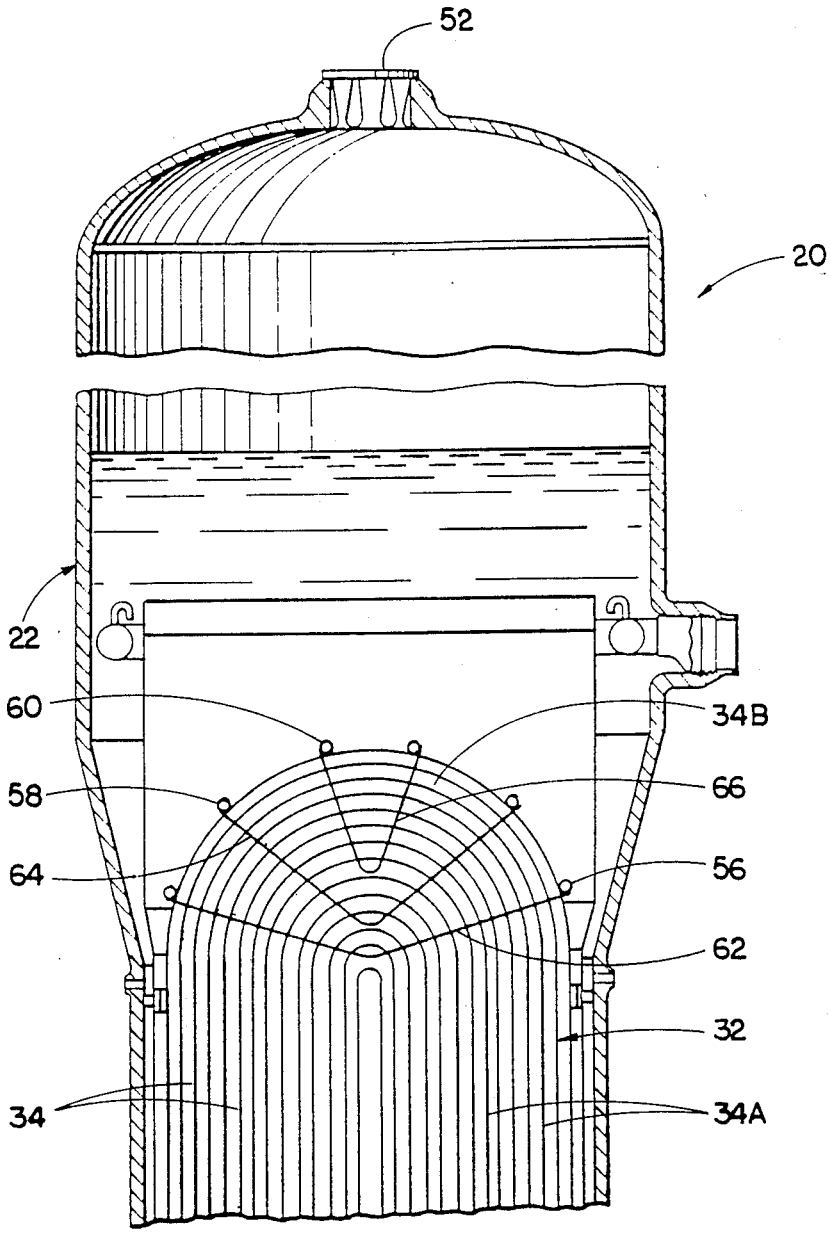
FIG. 2 (PRIOR ART)
FIG. 2 is a schematical axial sectional representation of the upper portion of the conventional steam generator of FIG. 1, illustrating the bent portions of the tubes and the installation position of the original antivibration bars.
Figure 3:
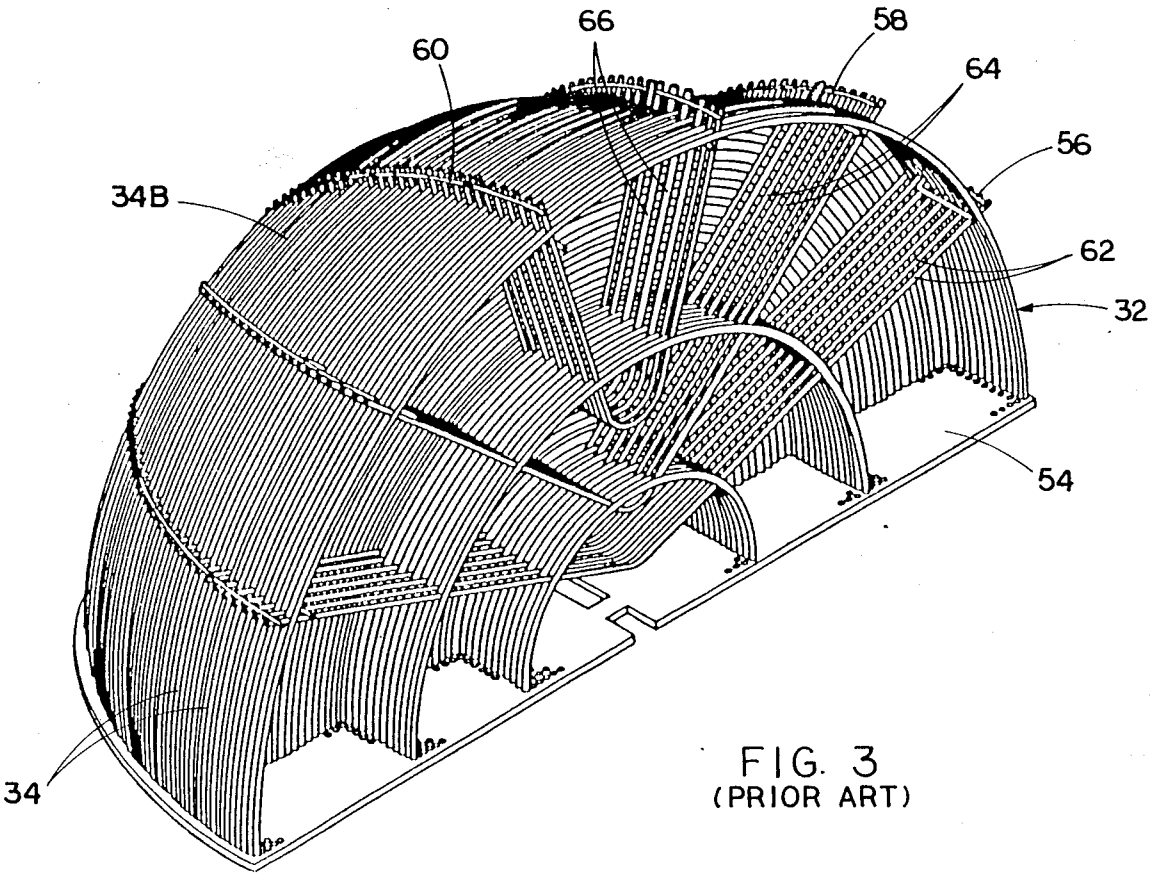
FIG. 3 (PRIOR ART)
FIG. 3 is an enlarged perspective view of the upper portion of the U-shaped bent tubes of FIG. 2.

Also, as shown in FIGS. 2 and 3, a plurality of sets of primary antivibration bars 62,64,66 are disposed between and support the bent or upper U-shaped portions 34B of the adjacent columns of tubes 34. One such set of the primary antivibration bars 62,64,66 is shown in FIG. 2. As shown in FIG. 3, successive sets of the primary bars 62,64,66 are disposed behind the one set. Although not shown in either FIG. 2 or 3, successive sets of the primary bars are also disposed in front of the one set of FIG. 2. Each of the primary antivibration bars 62,64,66 is of a V-shaped configuration with differing included angles. The included angles progressly reduce in size from highly obtuse for the lower bars 62 to highly acute for the upper bars 66. The opposite ends of the lower, middle and upper primary bars are rigidly attached, such as by welding, to symmetrically opposite points of the respective lower, middle and upper retainer rings 56,58,60.

Each of the primary antivibration bars 62,64,66 are installed in the steam generator 20 at the time of its original construction. However, as explained in the background section supra, because of the dimensional tolerances and variances and the requirement that the primary bars 62,64,66 be smaller in cross-section than the space between the adjacent columns of tubes 34 in order to permit insertion of the bars therebetween, the originally installed V-shaped primary antivibration bars 62,64,66 fail to completely eliminate the gap between the successive columns of tubes 34 in the bundle 32 thereof and thus to prevent vibration and wear.

2. Antivibration Apparatus of the Present Invention

Figure 4:
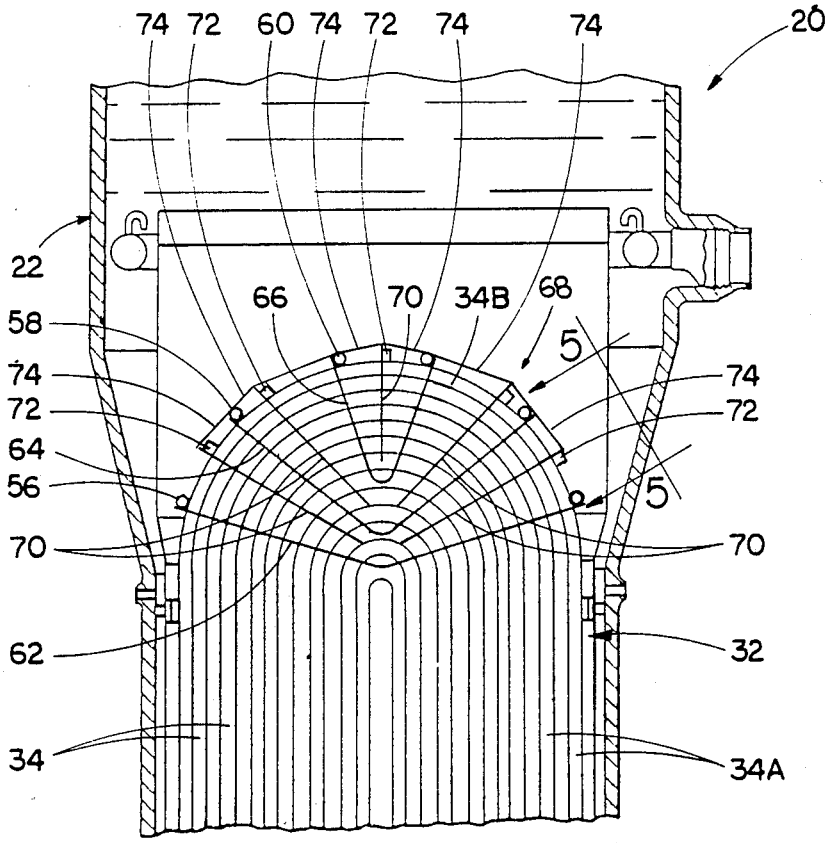
FIG. 4 is a view similar to that of FIG. 2, but also showing the steam generator tube antivibration apparatus of the present invention including supplementary antivibration bars installed along with the original antivibration bars.
Figure 5:
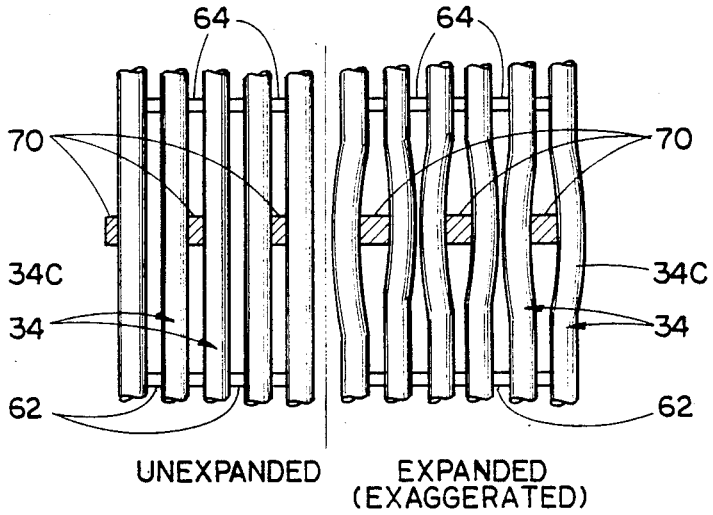
FIG. 5 is an enlarged fragmentary view of the original and supplementary antivibration bars as seen along line 5—5 of FIG. 4, illustrating unexpanded and expanded conditions of the supplementary bars.
Figure 8:
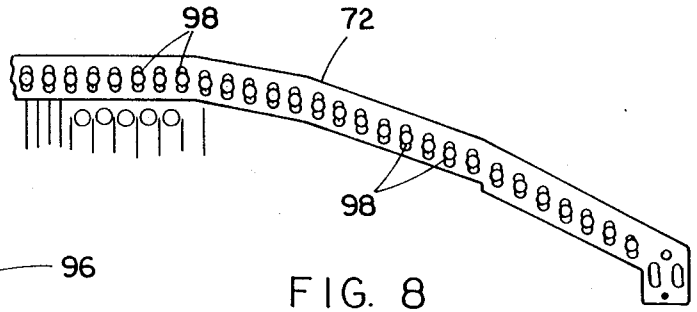
FIG. 8 is a front elevational view of a retainer plate of the apparatus of the present invention to which the supplementary antivibration bars are attached and from which they extend in cantilevered fashion.

Turning now to FIG. 4, there is shown the antivibration apparatus of the present invention, generally designated 68, which solves the problem of gaps remaining between the originally installed primary antivibration bars 62,64,66 and the U-shaped tube portions 34B of the columns of tubes 34. The antivibration apparatus 68 basically includes a plurality of rows elongated supplementary antivibration bars 70. As shown in FIGS. 4 and 5, a pair of rows of supplementary bars 70 are disposed between the lower and middle primary antivibration bars 62,64 and within the tube bundle 32 so as to extend the U-shaped portions 34B of the tubes 34 through the space between, at the most, every other one of the spaced columns of tubes. Support means in the form of a plurality of retainer plates 72 (also seen in FIG. 8) extend across the outside of the U-shaped portions 34B of the tubes 34 and rigidly attach the supplementary bars 70 to support them at their respective outer ends, and a plurality of coupling or tie bars 74 extend between and interconnect the retainer plates 72 and the lower and middle retainer rings 56,58. The supplementary bars 70 are unsupported at respective inner ends thereof and thereby extend in cantilevered fashion from the retainer plates 72 between the U-shaped portions 34B of the tubes 34. The connection to the tie bars 74 connected to the retainer rings 56,58 prevents vibration and hydraulic loads from causing migration of the cantilevered supplementary bars 70 from their desired positions.

As depicted schematically in FIG. 5, the supplementary bars 70 can be placed in expanded conditions as seen at the right side of the figure or unexpanded (or collapsed) conditions as shown at the left side of the figure. In their unexpanded (or collapsed) conditions, the supplementary bars 70 have transverse dimensions extending between the respective pairs of tubes 34 which are smaller than that of the respective primary bars 62,64 for facilitating installation of the supplementary bars between the tubes 34. Then, when placed in their expanded conditions, the supplementary bars 70 have transverse dimensions extending between the respective tubes which are greater than that of the primary bars 62,64 and any possible clearance gap between the primary bar and the tube 34. At such expanded dimension, each of the supplementary bar 70 will cause bowing or deformation laterally outward away from the respective supplementary bars of longitudinal spans 34C of the tubes extending between the lower and middle spaced rows of primary antivibration bars 62,64 so as to substantially close any clearance gaps existing between the U-shaped tube portions 34B in the columns thereof and the primary antivibration bars 62,64.

The supplementary bars 70, when installed at the midspans 34C of the tubes 34 between the existing original or primary bars 62,64, have the capability to move the adjacent tube columns laterally outward in opposite directions. The tube column expansion or bowing is accommodated by the natural flexibility of the tubes (instead of through use of replacement flexible bars as done heretofore). The flexibility of the tube spans 34C protects the tube cross-sections from inadvertent deformation. The tube column expansion is performed in every other or second column. In general, the objective of the apparatus of the present invention is to eliminate the gaps between the tubes 34 and the bars 62,64,66,70, and to maximize the support provided to the tubes. The low cost approach herein achieves the gap reduction-/elimination by relocating tubes to be in contact with the existing bars 62,64,66 (motion of the tubes is less than or equal to 0.020 inch). Support is maximized by the addition of a one sided preload on the tubes 34 at the mid-span 34C between the existing bars 62,64.

Figure 6:
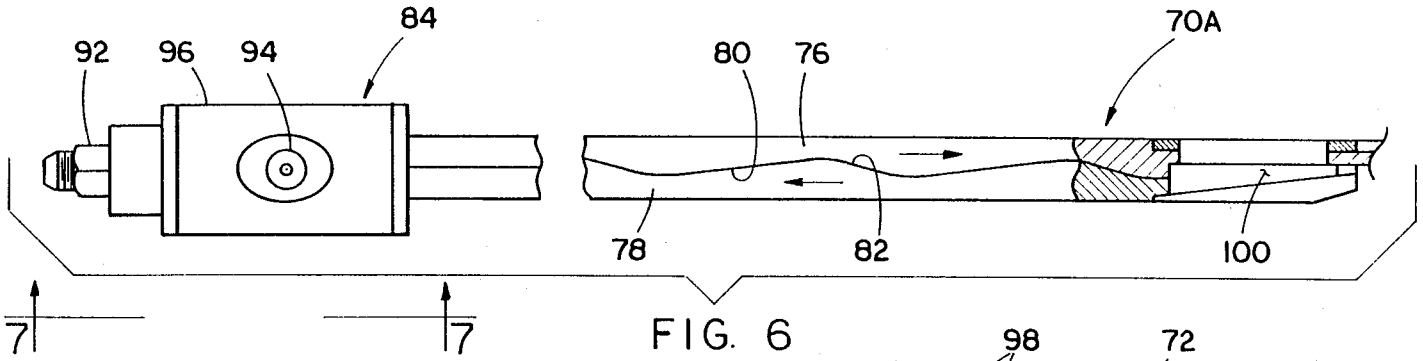
FIG. 6 is an enlarged plan view, with portions broken away, foreshortened and partially sectioned, of one embodiment of the supplementary antivibration bar utilized in accordance with the present invention.
Figure 7:
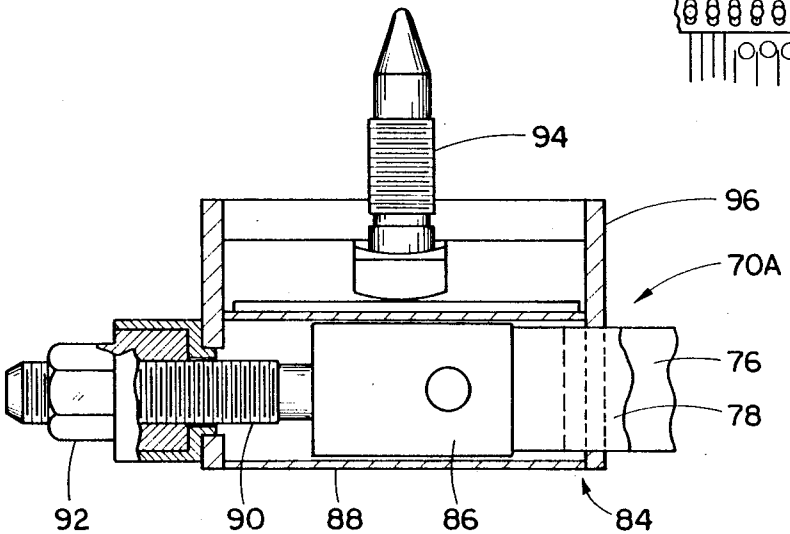
FIG. 7 is an enlarged side elevational view of a take-up mechanism of the bar as seen along line 7—7 of FIG. 6.

Two different embodiments of the supplementary antivibration bars 70 are illustrated respectively in FIGS. 6–7 and 9–11. The first embodiment of the supplementary bars 70A shown in FIGS. 6 and 7 is similar to the complete replacement expandable antivibration bars disclosed in above-cited U.S. Pat. No. 4,653,576. The expandable supplementary bar 70A has first and second side-by-side elongated portions 76,78. The bar portions 76,78 have two mating inclined (or undulating) surfaces 80,82 facing one another, and one of the bar portions is movable relative to the other. Thus, movement of one bar portion relative to the other will cause unmating of the surfaces 80,82 resulting in variation of the combined thickness of two bar portions. In the fully mated condition of the surfaces 80,82 as shown in FIG. 6, the supplementary bar 70A is in collapsed condition and at minimum thickness. In the fully unmated condition of the surfaces 80,82, the supplementary bar 70A is in its expanded condition and maximum thickness.

Relative motion between the two mating bar portions 80,82 is generated by a take-up mechanism 84 illustrated in FIGS. 6 and 7. The take-up mechanism 84 includes a clevis 86 slidable in a cylinder 88 and being attached to the outer end of the movable one 76 of the first and second bar portions 76,78. The outer end of the other stationary one 78 of the first and second bar portions 76,78 is connected to one end of the cylinder 88. A threaded stud 90 connects with the clevis 86 also and passes through the other end of the cylinder 88 and a nut 92 reacts against the end of the cylinder 88 to move the one bar portion 76. A bolt 94 is also anchored to a bracket 96 on the cylinder 88 and is attachable to one of the holes 98 in the retainer plate 72 of FIG. 8. Furthermore, the inner ends of the mating bar portions 76,78 are joined by a key 100 which allows relative movement of the portions.

Figure 9:
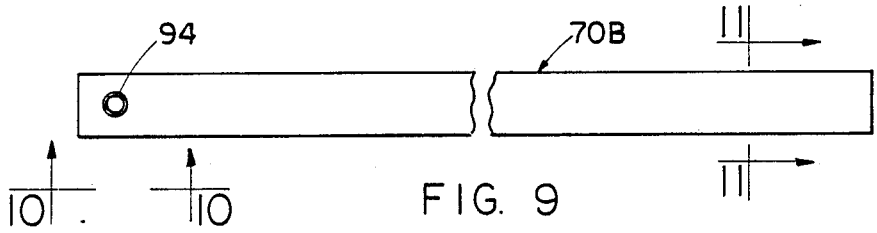
FIG. 9 is an enlarged plan view, in foreshortened form, of another embodiment of the supplementary antivibration bar utilized in accordance with the present invention.
Figure 10:
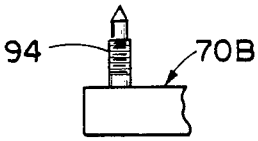
FIG. 10 is an enlarged side elevational view as seen along line 10—10 of FIG. 9 of an end of the bar for attachment to the retainer plate of FIG. 8.
Figure 11:
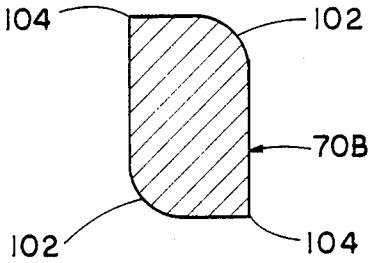
FIG. 11 is an enlarged cross-sectional view of the bar taken along line 11—11 of FIG. 9.

The expansion requirement can also be met with a "quarter-turn" supplementary antivibration bar 70B of the second embodiment shown in FIGS. 9 to 11. However, the degree of adaptability to unusual tolerance conditions in the tube bundle is less with this configuration than with the expandable bars 70A. Very tight conditions could probably not be accommodated with the quarter-turn bars 70B, whereas the expandable bars 70A can be expanded to any value smaller than the bars' expansion limit simply by stopping the expansion if a hard stackup condition is reached. A combination of quarter-turn and expandable bars 70A,70B can be used to provide installation flexibility and to further reduce costs.

Figure 12:
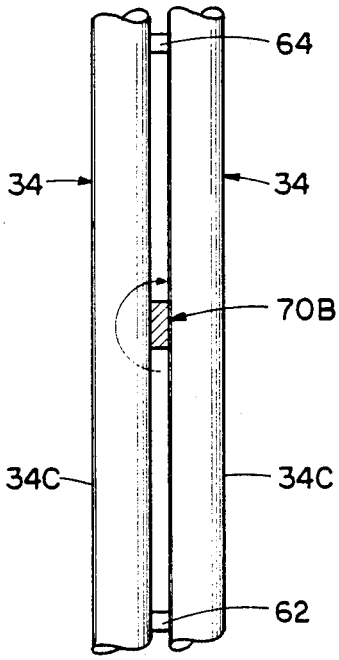
FIGS. 12 and 13 are schematic representations of sequential steps in the method of installing the supplementary antivibration bar of FIG. 9.
Figure 13:
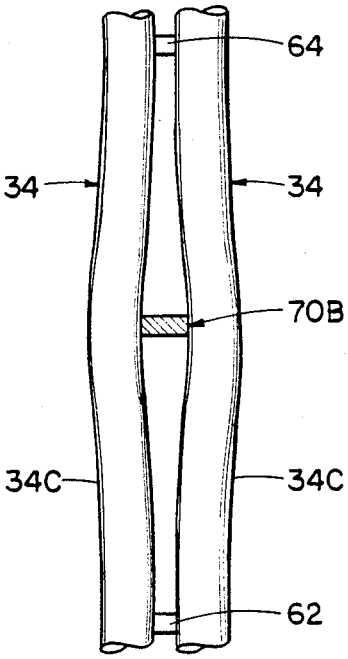

More particularly, each of the quarter-turn supplementary bars 70B is of rectangular cross-section with two pairs of diagonally opposite longitudinal edges 102,104. The bar 70B has a width greater than its thickness and is rounded off at the diagonal edge pair 102 and squared off at the other diagonal edge pair 104. The rounded off edges 102 adapt the bar 70B to be insertable with its thickness dimension extending between the respective adjacent tubes 34 as seen in FIG. 12, and then quarter-turned to position its width dimension therebetween, as seen in FIG. 13, to cause the laterally outward deformation of the longitudinal spans 34C of the tubes 34 away from one another. The thickness dimension of the supplementary bar 70B is smaller than the thickness of the original primary bars 62,64, whereas the width dimension is greater than the thickness of the primary bars plus 0.020 inch the nominal gap.

Optionally, a center supplementary antivibration bar 70 can also be employed by the antivibration apparatus 68, as seen in FIG. 4.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. In a steam generator for a nuclear reactor power plant including a bundle of U-shaped heat transfer tubes arranged in spaced rows and columns thereof, at least a pair of spaced rows of elongated primary antivibration bars installed between U-shaped portions of said tubes in said spaced columns thereof, and at least a pair of spaced apart retainer members disposed about the exterior of U-shaped portions of said tubes with opposite ends of said bars being rigidly attached to said respective retainer members, an antivibration apparatus for substantially closing gaps between said U-shaped tube portions in said columns thereof and said primary antivibration bars, said apparatus comprising:

(a) at least one row of a plurality of elongated supplementary antivibration bars having pairs of opposite ends, being disposed between said rows of said primary antivibration bars, and extending between said U-shaped portions of said tubes through the space between, at the most, every other one of said spaced columns thereof; and (b) means for supporting said supplementary bar at respective outer ends thereof such that said supplementary bars are unsupported at respective inner ends thereof and thereby extend in cantilevered fashion between said U-shaped portions of said tubes;

(c) each of said supplementary bars being capable of expansion in a transverse dimension thereof extending between said tubes so as to cause deformation laterally outward away from said respective bars of longitudinal spans of said tubes extending between said spaced row of primary antivibration bars for substantially closing any gaps existing between said U-shaped tube portions in said columns thereof and said primary antivibration bars.

2. The apparatus as recited in claim 1, wherein said supporting means includes at least one support member extending across the outside of said U-shaped portions of said tubes, said supplementary bars being rigidly attached at respective outer ends thereof to said support member.

3. The apparatus as recited in claim 2, wherein said supporting means further includes a plurality of tie bars extending between and interconnecting said support member and said retainer members.

4. The apparatus as recited in claim 1, wherein at least one of said supplementary bars has first and second side-by-side elongated portions, at least one of said portions being movable relative to the other and having an inclined surface thereon for causing variation in the combined thickness of said portions upon movement of said one portion relative to the other.

5. The apparatus as recited in claim 4, wherein said one supplementary bar further includes a take-up mechanism being connected to said first and second portions and being operable to move one portion relative to the other.

6. The apparatus as recited in claim 4, wherein at least one of said supplementary bars is of rectangular cross-section with two pairs of diagonally opposite longitudinal edges, has a width greater than its thickness and is rounded off at one pair of said diagonally opposite longitudinal edges and squared off at the other pair thereof adapting said one supplementary bar to be inserted with its thickness extending between said tubes and then quarter-turned to position its width therebetween to cause the laterally outward deformation of said longitudinal spans of said tubes.

7. The apparatus as recited in claim 1, wherein at least one of said supplementary bars is of rectangular cross-section with two pairs of diagonally opposite longitudinal edges, has a width greater than its thickness and is rounded off at one pair of said diagonally opposite longitudinal edges and squared off at the other pair thereof adapting said one supplementary bar to be inserted with its thickness extending between said tubes and then quarter-turned to position its width therebetween to cause the laterally outward deformation of said longitudinal spans of said tubes.

8. The apparatus as recited in claim wherein each of said supplementary bars is capable of collapsing to a transverse dimension smaller than that of said primary bar for facilitating installation of said supplementary bars between said tubes.

9. In a steam generator for a nuclear reactor power plant including a bundle of U-shaped heat transfer tubes arranged in spaced rows and columns thereof, at least a pair of spaced rows of elongated primary antivibration bars installed between U-shaped portions of the tubes in the spaced columns thereof, and at least a pair of spaced apart retainer members disposed about the exterior of U-shaped portions of the tubes with opposite ends of the bars being rigidly attached to the respective retainer members, a method of substantially eliminating gaps between the U-shaped tube portions in the columns thereof and the elongated primary bars, said method comprising the steps of:

(a) inserting at least one row of a plurality of elongated supplementary antivibration bars between the rows of the primary antivibration bars and between the U-shaped portions of the tubes at the most through the space between every other one of the spaced columns thereof; and (b) supporting the supplementary bars at respective outer ends thereof such that the supplementary bars are unsupported at respective inner ends thereof and thereby extend in cantilevered fashion between the U-shaped portions of the tubes;

(c) expanding each of the supplementary bars in a transverse dimension thereof extending between the tubes so as to cause deformation laterally outward away from the respective bars of longitudinal spans of the tubes extending between the spaced row of primary antivibration bars for substantially closing any gaps existing between the U-shaped tube portions in the columns thereof and the primary antivibration bars.

10. The method as recited in claim 9, wherein said supporting step includes rigidly attaching respective outer ends of the supplementary bars to a support member extending across the outside of the U-shaped portions of the tubes.

11. The method as recited in claim 10, wherein said supporting step further includes interconnecting the support member to the retainer members.

12. The method as recited in claim 9, wherein said expanding of each supplementary bar includes moving first and second longitudinally extending side-by-side portions thereof relative to one another.

13. The method as recited in claim 9, wherein said expanding of each supplementary bar includes quarter-turning said bar about its own longitudinal axis to disposed the width of the bar being greater than the thickness of the bar between the tubes.

* * * * *